US010420966B2

(12) United States Patent
Strand

(10) Patent No.: US 10,420,966 B2
(45) Date of Patent: Sep. 24, 2019

(54) WATER SURVIVAL MASK

(71) Applicant: Charlie Strand, Boulder, CO (US)

(72) Inventor: Charlie Strand, Boulder, CO (US)

( * ) Notice: Subject to any disclaimer, the term of this patent is extended or adjusted under 35 U.S.C. 154(b) by 123 days.

(21) Appl. No.: 15/712,155

(22) Filed: Sep. 22, 2017

(65) Prior Publication Data

US 2018/0289990 A1 Oct. 11, 2018

Related U.S. Application Data

(60) Provisional application No. 62/483,450, filed on Apr. 9, 2017.

(51) Int. Cl.

| | |
|---|---|
| ***A62B 18/02*** | (2006.01) |
| ***A62B 18/10*** | (2006.01) |
| ***B63C 11/12*** | (2006.01) |
| ***B63C 9/00*** | (2006.01) |
| ***A62B 18/08*** | (2006.01) |
| ***A63B 33/00*** | (2006.01) |
| ***B63C 11/16*** | (2006.01) |
| ***B63C 11/02*** | (2006.01) |
| ***A62B 9/02*** | (2006.01) |
| *B63C 11/18* | (2006.01) |

(52) U.S. Cl.

CPC ..... *A62B 18/025* (2013.01); *A62B 9/02* (2013.01); *A62B 18/084* (2013.01); *A62B 18/10* (2013.01); *A63B 33/00* (2013.01); *B63C 9/00* (2013.01); *B63C 11/12* (2013.01); *B63C 11/16* (2013.01); *B63C 11/184* (2013.01); *B63C 2011/027* (2013.01); *B63C 2011/128* (2013.01)

(58) Field of Classification Search

CPC ..... A62B 18/025; A62B 9/02; A62B 18/10; A63B 33/00; B63C 9/00; B63C 11/12; B63C 2011/128; B63C 11/16; B63C 11/18; B63C 11/205; B63C 11/184; B63C 2011/027

See application file for complete search history.

(56) References Cited

U.S. PATENT DOCUMENTS

| | | | | |
|---|---|---|---|---|
| 2,317,237 | A * | 4/1943 | Wilen | B63C 11/16 128/201.11 |
| 5,960,791 | A * | 10/1999 | Winefordner | B63C 11/205 128/201.11 |
| 2009/0133693 | A1* | 5/2009 | Peng | B63C 11/205 128/201.11 |
| 2017/0334531 | A1* | 11/2017 | Shiue | A62B 9/02 |
| 2018/0065719 | A1* | 3/2018 | Liao | B63C 11/14 |

* cited by examiner

*Primary Examiner* — Kristen Matter
(74) *Attorney, Agent, or Firm* — Will Hunziker

(57) ABSTRACT

A water survival mask that seals to the user's face covering the nose and mouth and preventing the unwanted inhalation of water. The mask lets air in through slots located at the bottom of the mask that also allow water to drain out. Once through the slots, water is prevented from entering the mask by a water impermeable barrier that selectively allows for air and not water to be inhaled, which may be a float valve. If water penetrates through the water impermeable barrier it is caught by splash guards and funneled back out of the mask before it can enter the primary airway of the user. The water survival mask works exceptionally well at preventing inhalation of windblown water droplets or wave water when floating in rough waters, thereby preventing pulmonary aspiration and pulmonary edema. It also prevents immediate inhalation of water do to submersion in cold water.

17 Claims, 5 Drawing Sheets

WATER SURVIVAL MASK

CROSS REFERENCE TO RELATED APPLICATIONS

This application claims the benefit of U.S. Provisional Patent Application No. 62/483,450, filed on Apr. 9, 2017, and titled "Water Survival Mask" which is incorporated by reference herein in its entirety for all purposes.

BACKGROUND OF THE INVENTION

1. Field of the Invention

The present invention is in the technical field of water survival masks. More particularly, the present invention pertains to the field of water survival masks that don't have snorkels or additional air supplies.

2. Description of Related Art

For recreational diving it's common to use snorkeling or scuba gear that allows you to safely traverse either the top of the water or underwater in calm water conditions; however; in emergency situations where you may have a man overboard or a ship is going down the weather is often less than ideal and there may be limited time to put on snorkel or scuba gear; and if you manage to put on such gear it may not be effective for survival in rough waters. Often in a water rescue situation a potential downing victim may only have a brief amount of time to put on water survival gear, such as a cold water survival suit and they may also not be trained in how to use snorkel or scuba gear which may not work under the conditions thy are required to survive in.

Without water survival gear a man overboard may be faced with a barrage of high waves that make breathing difficult or with high winds that can blow water, fluids, or debris particles into their lungs causing pulmonary aspiration and pulmonary edema (or secondary drowning); which is caused by the build up of water or fluid in the lungs. There has long been a need for a water survival mask which prevents the inhalation of wind blown water and allows the user to breathe freely even in rough water conditions that can be used quickly and with minimal training. The present invention solves all of these needs and will be effective in saving many lives.

SUMMARY

The scope of the present invention is defined solely by the appended claims and detailed description of a preferred embodiment, and is not affected to any degree by the statements within this summary. In addressing many of the problems experienced in the related art, such as those relating to using scuba or snorkeling gear for emergency water evacuations; embodiments of the present invention provide for a small, lightweight, and easily usable water survival mask. The mask can be attached to standard water survival gear and prevent inhalation of water due to blowing winds, waves, water insertions, and cold—among other things. The mask may have one or more water impermeable barriers and internal chambers, which may also have splashguards to prevent the inhalation of water. While the mask will not work for prolonged periods of time under water it is suitable for use as a breathing apparatus for those floating in water in rough conditions.

BRIEF DESCRIPTION OF THE DRAWINGS

Various embodiments are described herein with reference to the following Drawings. Certain aspects of the Drawings are depicted in a simplified way for reasons of clarity. Not all alternatives and options are shown in the Drawings and, therefore, the Claims are not limited in scope to the content of the Drawings.

1. FIGURES

Figure 1:
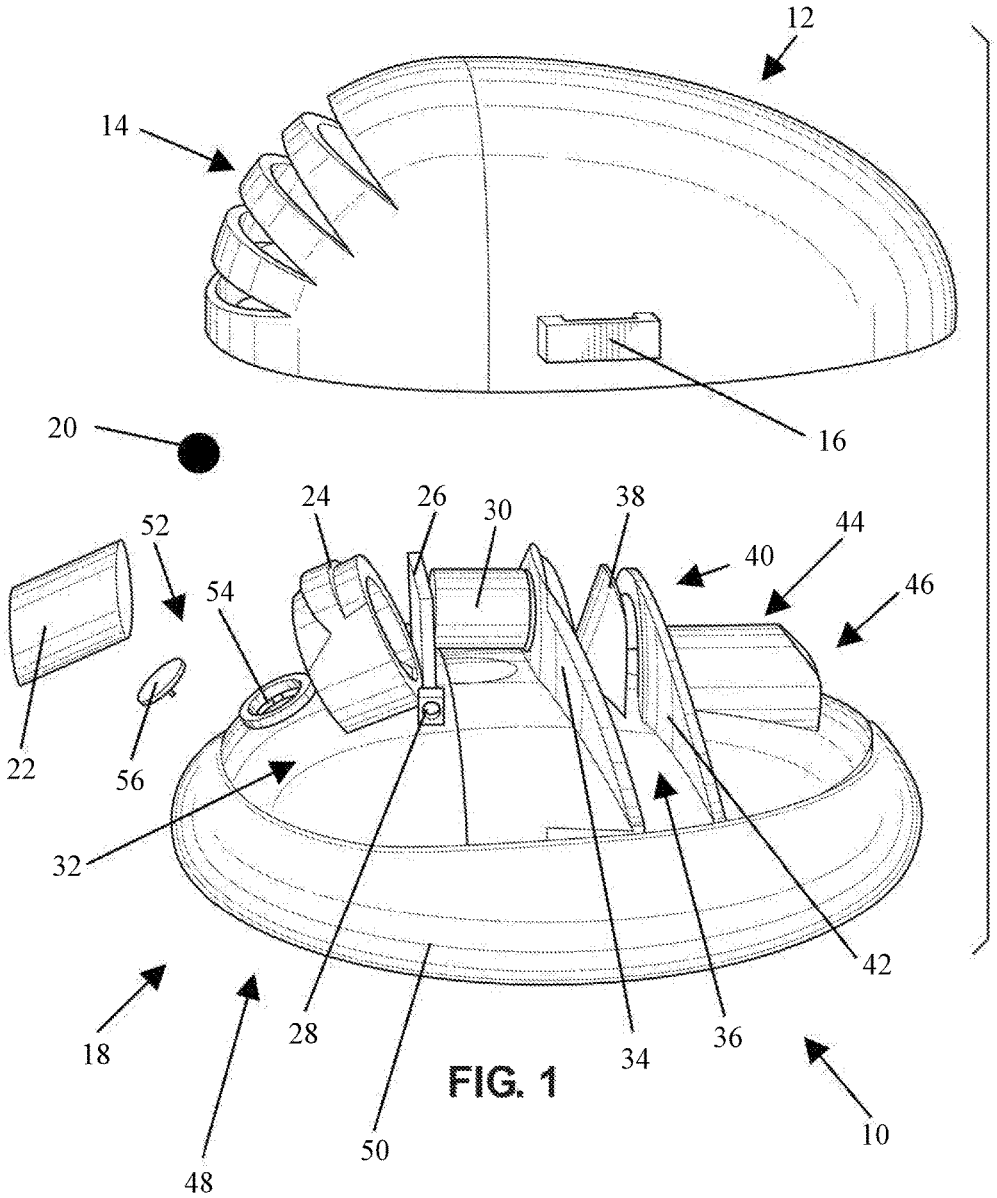

FIG. 1 illustrates an exploded side view of a water survival mask, in accordance with an embodiment of the present disclosure.

Figure 2:
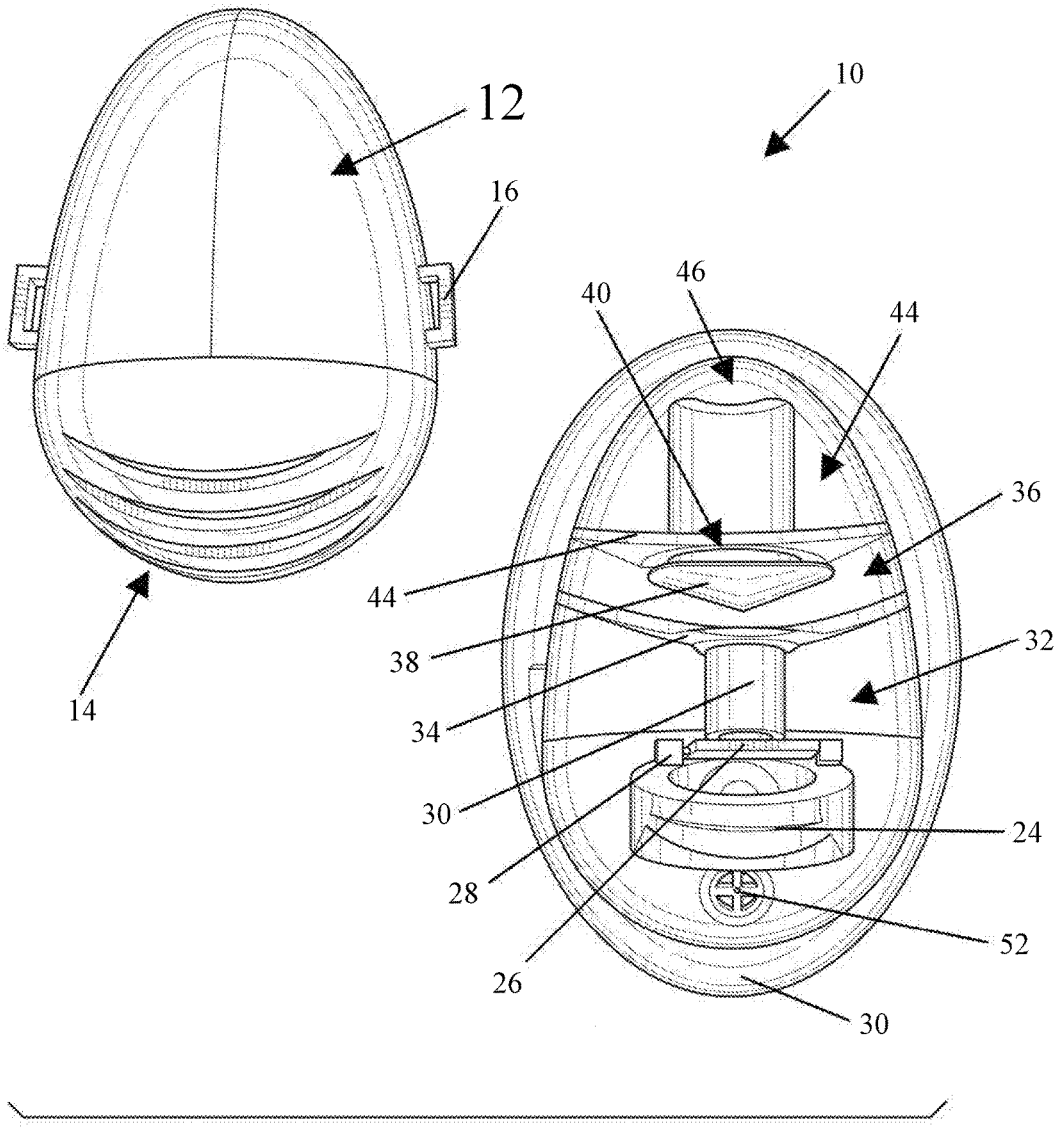

FIG. 2 illustrates an exploded front view of a water survival mask, in accordance with an embodiment of the present disclosure.

Figure 3:
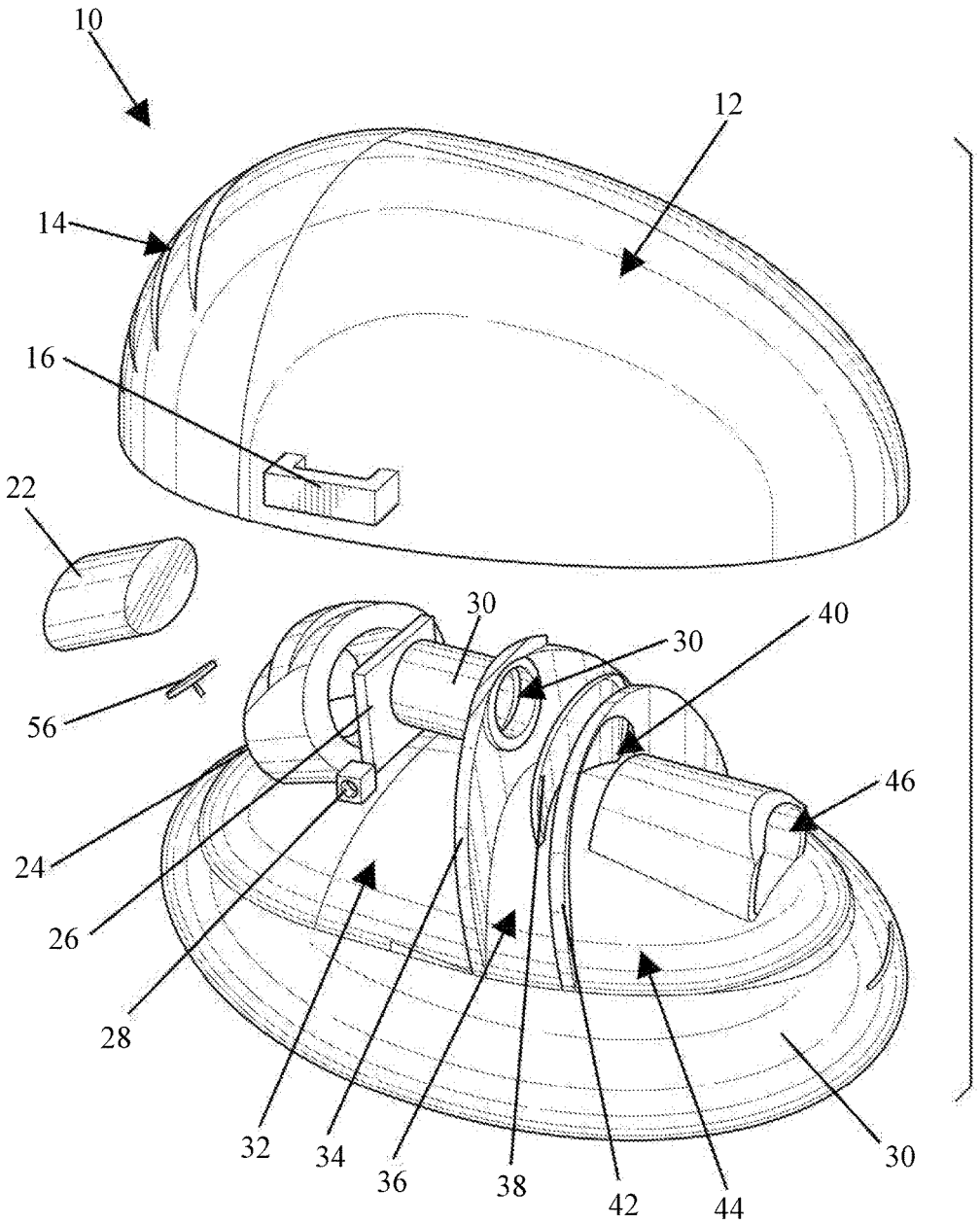

FIG. 3 illustrates an exploded perspective view of a water survival mask, in accordance with an embodiment of the present disclosure.

Figure 4:
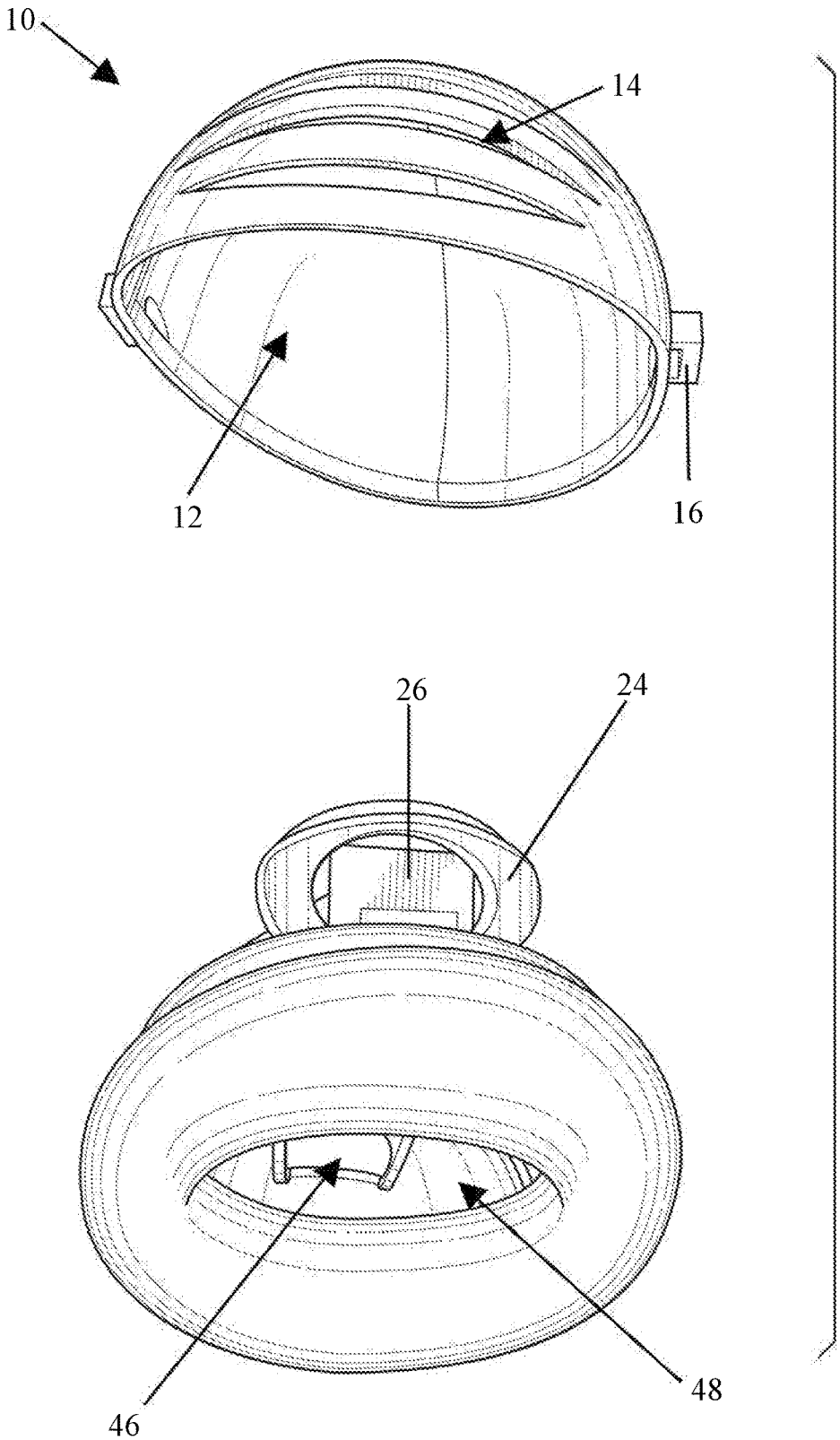

FIG. 4 illustrates an exploded upward view of a water survival mask, in accordance with an embodiment of the present disclosure.

Figure 5:
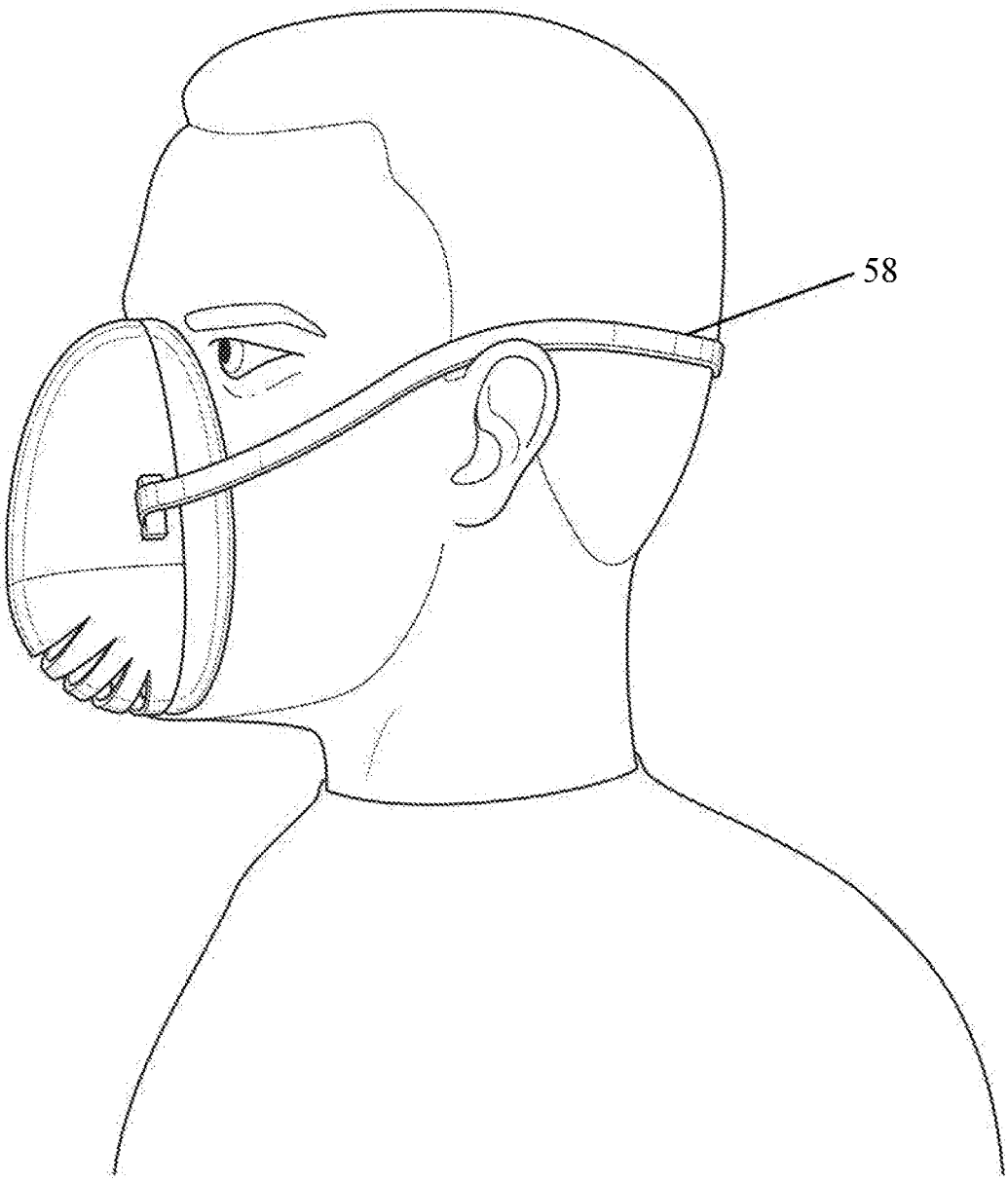

FIG. 5 illustrates a perspective view of a water survival mask on a user, in accordance with an embodiment of the present disclosure.

Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiment are often not depicted in order to facilitate a less obstructed view of these various embodiments of the present disclosure.

2. REFERENCES

10 Water Survival Mask
12 Outer Splash Shield
14 Air Slots
16 Head Connectors
18 Inner mask Assembly
20 Water Impermeable Barrier
22 Float
24 Float Chamber
26 Float Valve closure
28 Float Valve Closure Hinge
30 Float Valve Air Channel
32 Water Impermeable Barrier Chamber
34 First Internal Chamber Seal
36 First internal Chamber
38 Splashguards
40 Air Channel
42 Second Internal Chamber Seal
44 Third Internal Chamber
46 Air Channel Into Chamber Directly Against Face
48 Chamber Directly Against User's Face
50 Mask Face Seal
52 Air or Water Discharge Valve

54 Discharge Valve Port
56 Discharge Valve Soft Seal
58 Strap

DETAILED DESCRIPTION

The following description is not to be taken in a limiting sense, but is made merely for the purpose of describing the general principles of exemplary embodiments, many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

Further, the described features, structures, or characteristics of the present disclosure may be combined in any suitable manner in one or more embodiments. In the Detailed Description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well-known structures, materials, or operations are not shown or described in detail to avoid obscuring aspects of the present disclosure. Any alterations and further modifications in the illustrated devices, and such further application of the principles of the invention as illustrated herein are contemplated as would normally occur to one skilled in the art to which the invention relates.

Unless otherwise indicated, the drawings are intended to be read (e.g., arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" mean positioned or supported on but not necessarily in direct contact with the surface.

The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The terms "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

For the purposes of promoting an understanding of the principles of the present invention, reference will now be made to the embodiments illustrated in the drawings and specific language will be used to describe the same. Generally, embodiments of the water survival mask comprise a compact mask designed to protect the human airway from inhalation of water, fluids, or debris (pulmonary aspiration) and is intended to be used with other lifesaving equipment, including life jackets and immersion suits, in emergency aquatic survival situations. The mask is intended to be stored with either a life jacket (personal flotation device: PFD) or an immersion suit and potentially attached to International Convention for the Safety of Life at Sea (SOLAS) equipment for convenience.

Embodiments of the mask can be used at any time while out on the water for safety but is designed to worn for survival in high winds (near gale or higher), rough seas, tropical storms, and hurricane conditions. Additionally, the mask may be designed to work specifically with life jackets and immersion suits in upright and reclined positions and fit with such equipment.

The design comprises an airtight seal around the mouth and nose. When the masked is submerged, a float valve seals the mask's internal air channels. Above the water, channeled airways prevent water from entering the nose and mouth. Internal splashguards are also used to prevent wave or rainwater intake. Exhales push any small amounts of water out clearing the internal chambers. Some designs may also use one or more discharge valves to discharge air or water as well.

Embodiments of the water survival mask prevent nearly all water inhalation while: entering the water, during unexpected submerges, splashes from rough sea waves, sea spray due to high winds, damp clothes covering airways, and other potential water inhalation events—this allows for smooth, calm breathing even while extreme sea conditions make it difficult to breathe due to breaking waves, sea spray, repeated forced immersions, and other events; increasing the user's overall odds of survival. The effects of water inhalation and aspiration include: extreme difficulty breathing, increased heart rate, uncontrolled coughing or gagging which may lead to advanced water inhalation and aspiration causing further panic and wasted energy, all of which lower your chances of survival. Additionally, victims of water inhalation are at risk of what is called "dry drowning" where fluids are collected during struggles to breathe causing muscles to spasm and close off your airway. Victims of water inhalation are also at risk of what is called "secondary drowning", also known as pulmonary edema, which is the build up of excess fluids in the lungs that can lead to death from water inhalation up to 48 hours after being saved from the water.

Additionally, embodiments of this water survival mask are exceptionally beneficial in cold water condition for two reasons: first, upon entering the water, the instant cold can cause in involuntary intake of air or water, gagging, and coughing; second, the mask maintains heat from exhaled air which reheats air entering the mask and lungs.

Of importance in embodiments of the present invention is that they do not require additional supplies of air or a snorkel, either of which would require upkeep and basic training. The user simply needs to place the mask over their face for smooth and steady breathing even in the harshest of water conditions.

FIG. 1 illustrates an exploded side view of a water survival mask, in accordance with an embodiment of the present disclosure. In this embodiment a water survival mask (10) is shown. The water survival mask (10) may have an outer splash shield (12) that prevents water from entering the inner chambers of the mask, the outer splash shield may also comprise one or more air slots (14) which allow air to enter and leave the mask and one or more head connectors (16) and possibly straps (58) as shown in FIG. 5; such straps securing the mask to the user's face. The head connector (16) can be anything known in the art to attach something to one's head; such as but not limited to: straps, webbing, a hood, a belt, clips, buttons, snaps, hooks, Velcro, elastic bands, rings, ties, ear loops, etc.

Still referring to FIG. 1, the outer splash shield (12) forms a waterproof connection with an inner mask assembly (18), protecting it from taking water in except through the air slots (14). When air or water enter the air slots (14), a water impermeable barrier (20), selectively allows for air and not water to be inhaled and exhaled. The water impermeable barrier may be any barrier that selectively allows for air and not water to be inhaled, such as a valve, a membrane, or any other barrier know in the arts. In the present embodiment a float valve is used as the water impermeable barrier (20). The float valve comprises: a float (22) a float chamber (24) to hold the float, a float valve closure (26), a float valve closure hinge (28), and a float valve air channel (30).

When water passes through the air slots (14) and enters the water impermeable barrier chamber (32) it raises the float (22) which slides upwards in the float chamber (24) and presses against the float valve closure (26) which tilts on its hinge (28) and seals the float valve closure against the float valve air channel (30) preventing water from going from the float valve air chamber (32) through the water impermeable barrier channel (32), which in conjunction with a first internal chamber seal (34), prevents water from the water impermeable barrier chamber from entering the first internal chamber (36). If water enters the first internal air chamber (36) it will be deflected by splashguards (38) before it can pass through an air channel (40) in a second internal chamber seal (42) and into a second internal chamber (44). The splashguards keep the water near the float valve closure (26) where it can be purged with the next exhale. Air then goes from the second internal chamber (44) through an air channel (46) into a chamber directly against the user's face (48). The internal chamber directly against the user's face (48) is water tight because of a mask face seal (50), which may be rubber or any other material suitable for its intended purpose.

In this embodiment of the present invention water must move from the exterior environment, though a water impermeable barrier, then through one or more internal chambers with splashguards, then through another chamber before it can finally enter the immediate air supply of the user.

Still referring to FIG. 1, another embodiment of the invention may optionally have additional air or water discharge valves (52), such as a basic flap valve with a discharge valve port (54) and a discharge soft valve (56). Such valves allow the user to purge any air or water that has accumulated in the internal chamber directly against the user's face (48).

FIGS. 2, 3 and 4 illustrate exploded top, side, and bottom perspective views accordingly of the same embodiment of a water survival mask as illustrated in FIG. 1.

FIG. 5 illustrates a perspective view of a water survival mask on a user secured to a user's face with one or more straps (58).

Information as herein shown and described in detail is fully capable of attaining the above-described object of the present disclosure, the presently preferred embodiment of the present disclosure; and is, thus, representative of the subject matter; which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

What is claimed is:

1. A water survival mask, comprising:

an outer splash shield with one or more air slots;

a water impermeable barrier that selectively allows for air and not water to be inhaled and exhaled;

a first internal chamber comprising splashguards therein;

a mask face seal;

a head connector; and a chamber configured to be sealed directly against a user's face.

2. The water survival mask of claim 1, wherein said one or more air slots are faced downward to allow water to drain out of the mask.

3. The water survival mask of claim 1, further comprising a water impermeable barrier chamber through which air and water can enter from said one or more air slots in said splash shield and which water is prevented from entering said first internal chamber by said water impermeable barrier.

4. The water survival mask of claim 1, further comprising a second internal chamber.

5. The water survival mask of claim 4, further comprising splashguards in said second internal chamber.

6. The water survival mask of claim 1, further comprising air or water discharge only valves.

7. The water survival mask of claim 6, wherein said air or water discharge only valves are attached to said chamber directly against a user's face.

8. The water survival mask of claim 6, wherein said air or water discharge only valves comprise a basic flap valve with a discharge valve port and a discharge soft valve.

9. The water survival mask of claim 1, wherein said water impermeable barrier is a valve.

10. The water survival mask of claim 9, wherein said valve is a float valve.

11. The water survival mask of claim 1, wherein said water impermeable barrier is a selectively permeable membrane.

12. The water survival mask of claim 1, further comprising a head strap.

13. A water survival mask, comprising:

an outer splash shield with one or more air slots that are faced downward to allow water to drain out of the mask;

a water impermeable barrier that selectively allows for air and not water to be inhaled and exhaled;

a first internal chamber;

splashguards in said first internal chamber;

a water impermeable barrier chamber through which air and water can enter from said one or more air slots in said splash shield and which water is prevented from entering said first internal chamber by said water impermeable barrier;

a second internal chamber;

a chamber configured to be sealed directly against a user's face;

a head connector; and a mask face seal.

14. The water survival mask of claim 13, further comprising air or water discharge only valves attached to said chamber directly against a user's face.

15. The water survival mask of claim 13, wherein said water impermeable barrier is a valve.

16. The water survival mask of claim 15, wherein said valve is a float valve.

17. The water survival mask of claim 13, wherein said water impermeable barrier is a selectively permeable membrane.

* * * * *